US005815832A

United States Patent [19]

Skolik

[11] Patent Number: 5,815,832

[45] Date of Patent: Oct. 6, 1998

[54] ASSEMBLY AND METHOD FOR MOVING AN EYESHIELD BETWEEN POSITIONS ON A HAT

[76] Inventor: Stephanie A. Skolik, 706 11th Ave., Huntington, W. Va. 25701

[21] Appl. No.: 825,219

[22] Filed: Mar. 27, 1997

[51] Int. Cl.[6] ..... A42B 1/06

[52] U.S. Cl. ..... 2/10; 2/195.1; 2/209.13; 351/155

[58] Field of Search ..... 2/10, 195.1, 209.13, 2/12, 175.1; 351/155

[56] References Cited

U.S. PATENT DOCUMENTS

| | | | |
|---|---|---|---|
| 899,334 | 9/1908 | Seitzman . | |
| 1,170,462 | 2/1916 | Schroeder . | |
| 2,179,719 | 11/1939 | Goskey . | |
| 2,601,149 | 6/1952 | Jamison, Jr. . | |
| 5,105,475 | 4/1992 | Lynd et al. . | |
| 5,197,150 | 3/1993 | Bedient | 2/10 X |
| 5,355,535 | 10/1994 | Bruder . | |
| 5,473,778 | 12/1995 | Bell | 2/10 |
| 5,481,760 | 1/1996 | Wood, Jr. . | |

FOREIGN PATENT DOCUMENTS

| | | | |
|---|---|---|---|
| 057205 | 1/1940 | Denmark | 2/10 |
| 700393 | 12/1930 | France | 2/10 |

*Primary Examiner*—Peter Nerbun
*Attorney, Agent, or Firm*—Jerome D. Jackson

[57] ABSTRACT

An eye shield assembly for attaching to a cap. The assembly includes an envelope for storing a transparent or translucent eyeshield that may be moved from a retracted position when the eyeshield is not required to an extended position to protect the wearer's eyes, thereby providing either visual enhancement or a fashionable appearance.

25 Claims, 15 Drawing Sheets

ASSEMBLY AND METHOD FOR MOVING AN EYESHIELD BETWEEN POSITIONS ON A HAT

BACKGROUND OF THE INVENTION

1. Field of the Invention

This invention relates generally to eye protection and, more particularly, to an eye shield assembly that is convenient to wear.

2. Description of Related Art

Human eyes are vulnerable in a variety of work place environments. For example, in a shop where metal is hammered onto metal, harmful projectiles may lodge into the eyes unless precautions are made. A standard precaution is to wear safety glasses or safety goggles. Because such devices often lack comfort or convenience, many people resist wearing them in dangerous environments, resulting in preventable eye injuries.

SUMMARY OF THE INVENTION

It is an object of the present invention to provide an eyeshield assembly that is convenient and comfortable.

It is another object of the present invention to provide an eyeshield assembly that attaches to a conventional cap.

To achieve this and other objects of the present invention, a hat for wearing on the head of a person and for protecting the eyes of the person, comprises a dome including a cloth part with at least one layer of woven fabric, the cloth part defining most of an interior surface of the dome and defining most of an exterior surface of the dome, a member positioned to define a chamber between the member and the interior surface, and an eyeshield configured to allow movement of the eyeshield from a first position inside the chamber, and a second position outside the chamber.

According to another aspect of the present invention, an assembly for protecting the eyes of a person and for attaching to a hat for wearing on the head of the person, the hat including a dome with a cloth part with at least one layer of woven fabric, the cloth part defining most of an interior surface of the dome and defining most of an exterior surface of the dome, comprises a wall; a mechanism for attaching the wall to the hat, to define a chamber between the wall and the interior surface, and an eyeshield configured to allow movement of the eyeshield from a first position inside the chamber, and a second position outside the chamber.

The accompanying drawings which are incorporated in and which constitute a part of this specification, illustrate embodiments of the invention and, together with the description, explain the principles of the invention, and additional advantages thereof. Throughout the drawings, corresponding parts are labeled with corresponding reference numbers.

DESCRIPTION OF THE PREFERRED EMBODIMENTS

Figure 1:
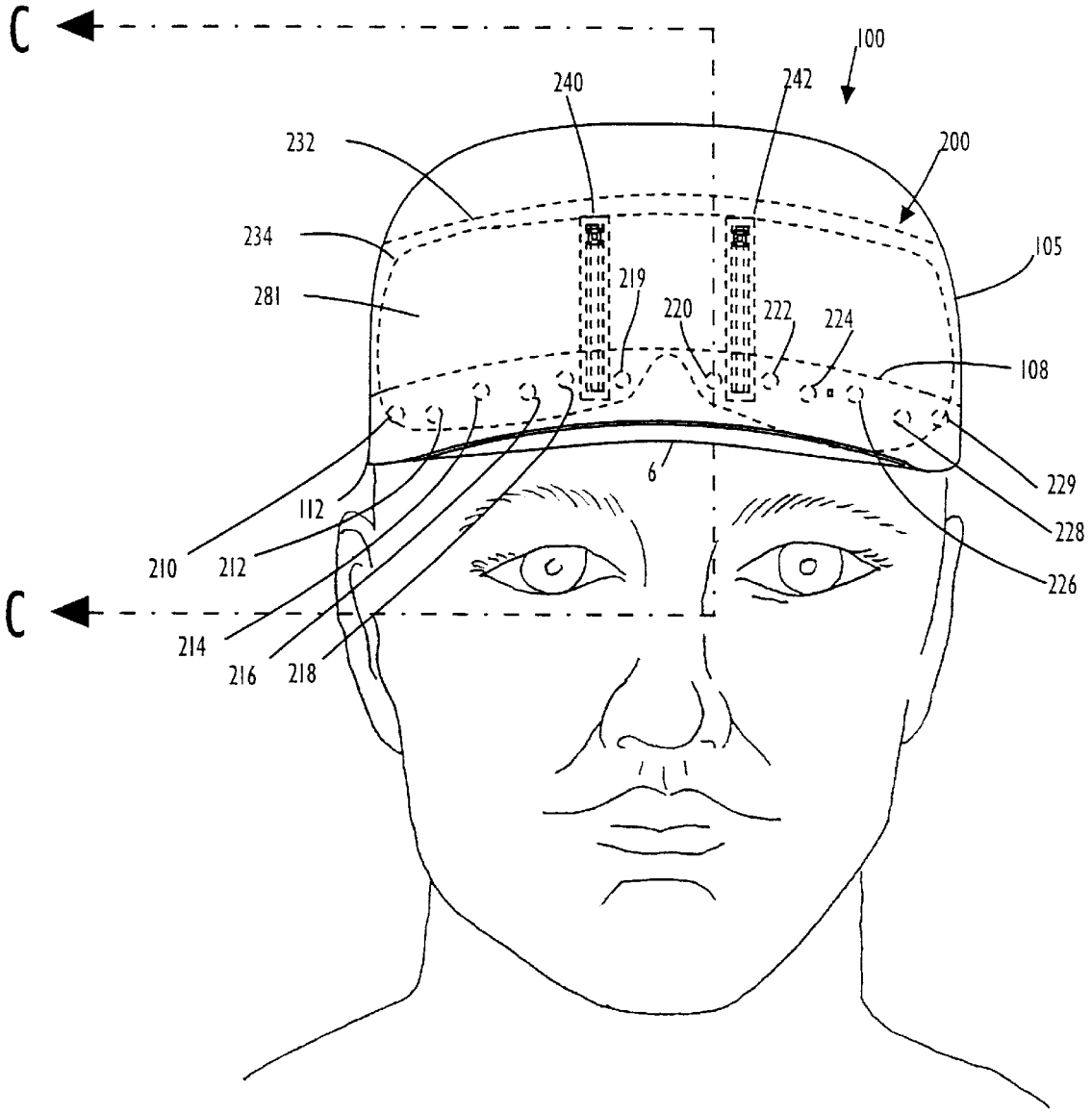
FIG. 1 is a front view of a hat including the eyeshield assembly of the first preferred embodiment of the present invention.

FIG. 1 shows a baseball-type safety hat 100 according to the first preferred embodiment of the present invention. Hat 100 includes dome 105. Dome 105 includes at least one layer of woven cotton fabric. Hat 100 also includes bill 6 including a relatively rigid material, Such as plastic or cardboard covered with fabric. A hat headband 108, shown in dotted outline, is inside hat 100. Hat headband 108 is attached to dome 105 along the rim 112 of hat 100, as shown in more detail in subsequent figures.

Safety hat 100 includes an eyeshield assembly 200, shown in dotted outline, inside of hat 100. Assembly 200 includes fasteners 210, 212, 214, 216, 218, 219, 220, 222, 224, 226, 228, and 229, for connecting assembly 200 to hat headband 108. Assembly 200 includes envelope 232 and eyeshield 234 slidably engaged with envelope 232, via channels 240 and 242, as described in more detail below.

Envelope 232 is composed of fabric. Each of channels 240 and 242 is composed of plastic.

As depicted in FIG. 1, eyeshield 234 is in the retracted position, allowing a person to wear hat 100 without displaying eyeshield 234.

Figure 2:
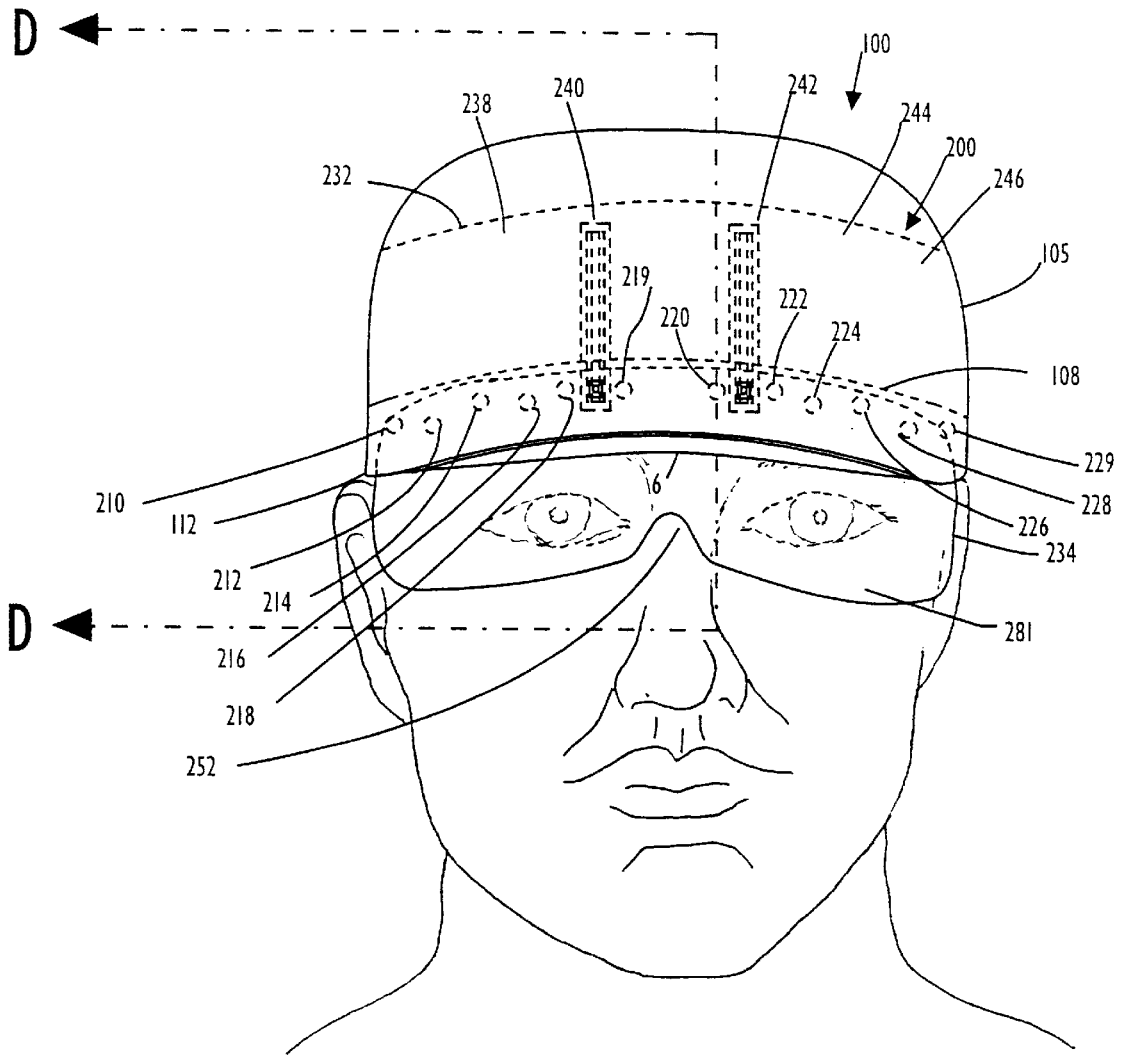
FIG. 2 is another front view of the first preferred assembly, showing the eyeshield in an extended position to protect the wearer's eyes.

FIG. 2 shows hat 100 with shield 234 in the extended position, such that shield 234 is in front of the wearer's eyes (in optical registration with the wearer's eyes). Shield 234 defines an arch 252 to accommodate the wearer's nose. Shield 234 includes a polycarbonate material. An injection molding process allows shield 234 to be thin and have good optical quality. Depending on details of the process, shield 234 may be corrective, or tinted to provide anti-glare and anti-UV properties for recreational or industrial (i.e., welding) protection.

Figure 3:
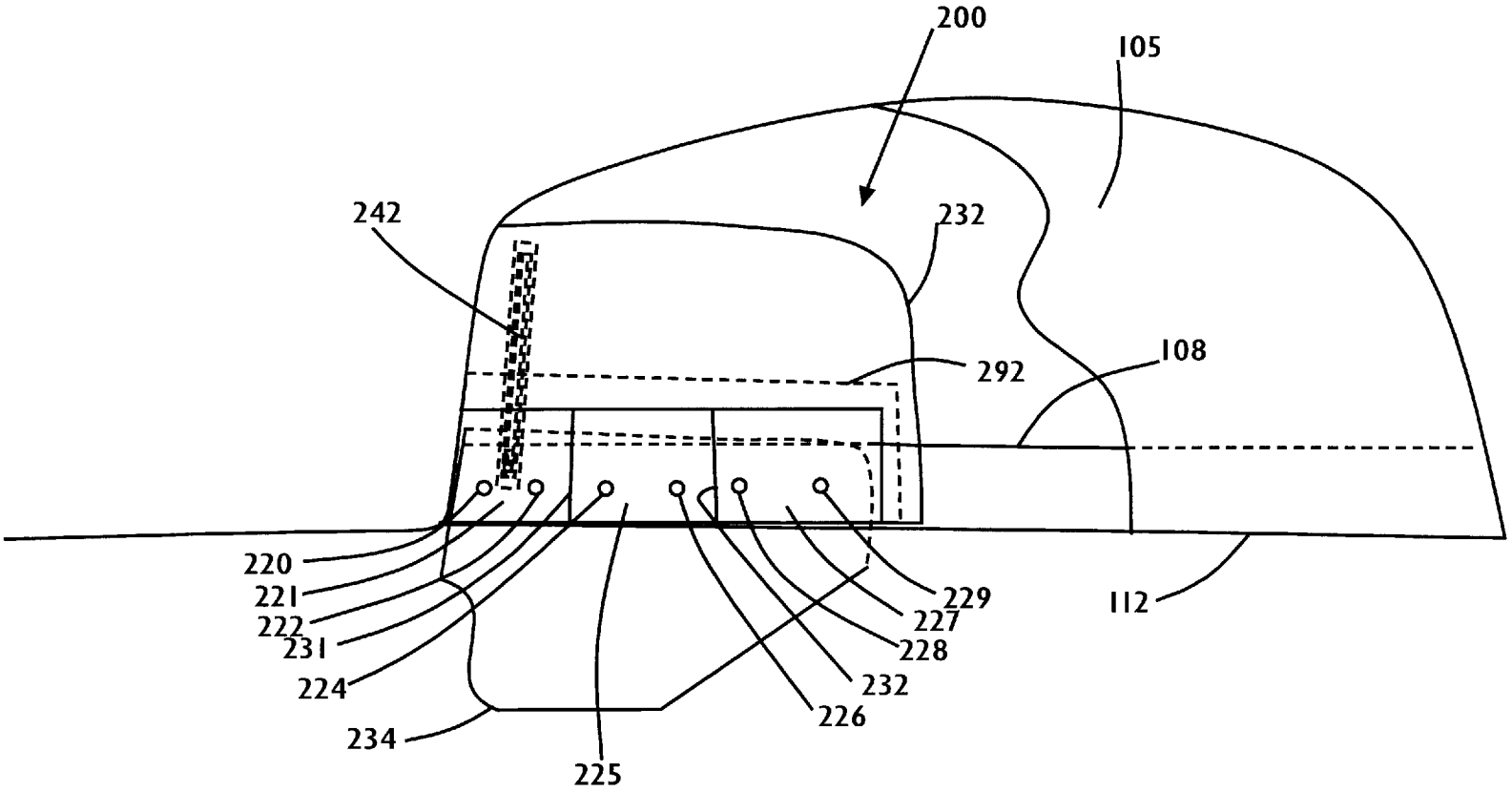
FIG. 3 is a side view showing the first preferred embodiment with the eyeshield in the extended position.

FIG. 3 shows a side view of hat 100, with eyeshield 234 in the extended position, emphasizing other features of assembly 200. In FIG. 3, part of dome 105 has been omitted to reveal envelop 232 and other parts of hat 100.

Assembly 200 includes an assembly headband 292 attached to the inboard side of envelope 232.

Each fastener of assembly 200 includes a convex part, on the main body of envelope 232, and a concave part on a fabric flap attached to envelope 232. Each of fabric flaps 221, 225, and 227 is attached to envelope 232 by sewing. The respective concave parts of fasteners 220 and 222 are attached to fabric flap 221. The respective concave parts of fasteners 224 and 226 are attached to fabric flap 225. The respective concave parts of fasteners 228 and 229 attached to fabric flap 227. Flap 221 is separated from flap 225 by division 231. Flap 225 is separated from flap 227 by division 232. These separate flaps facilitate the attachment of assembly 200 to headband 108.

Figure 4:
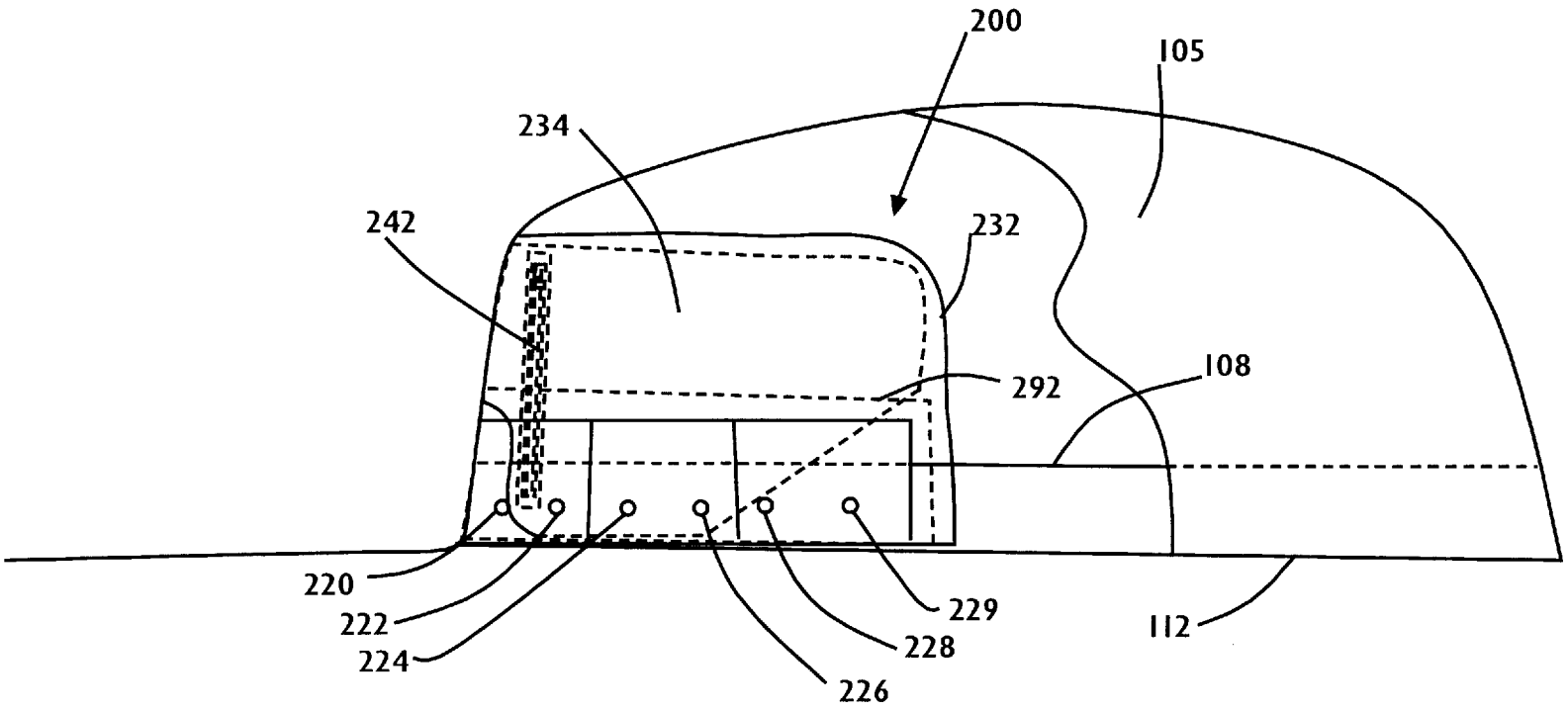
FIG. 4 is another side view showing the eyeshield in the retracted position.

FIG. 4 shows eyeshield 234 in the retracted position. In FIG. 4, each of vertical lines 10 are perpendicular to a horizontal line defined by rim 112 of hat 100.

In FIG. 4, channel 242 runs parallel to the plane of the paper. Channels 240 (not shown in FIG. 4) also runs parallel to the plane of the paper in FIG. 4.

Figure 5:
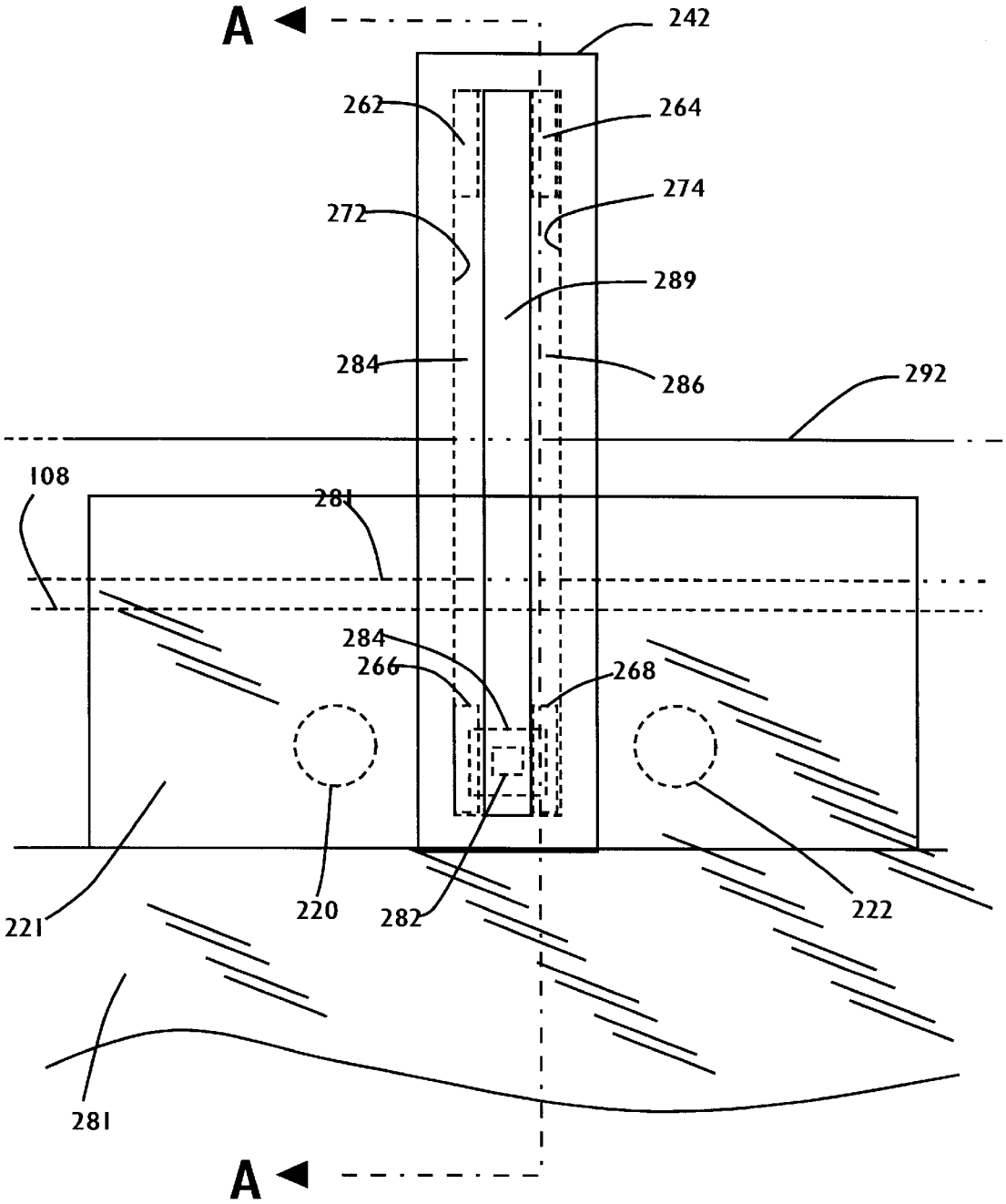
FIG. 5 is a plan view showing a some of the features of FIG. 3 in more detail.
Figure 6:
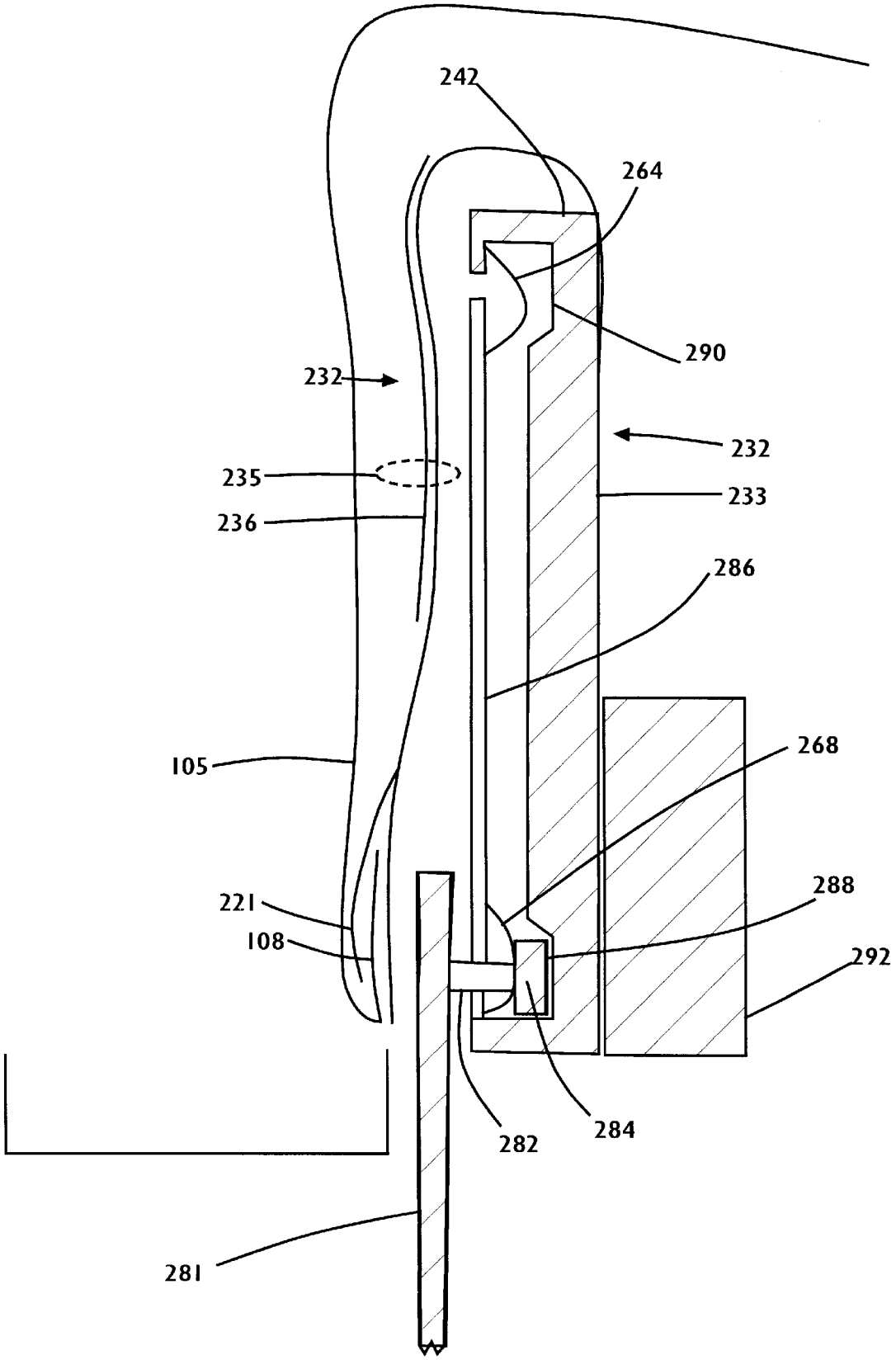
FIG. 6. is a view taken along the line A—A of FIG. 5.
Figure 7:
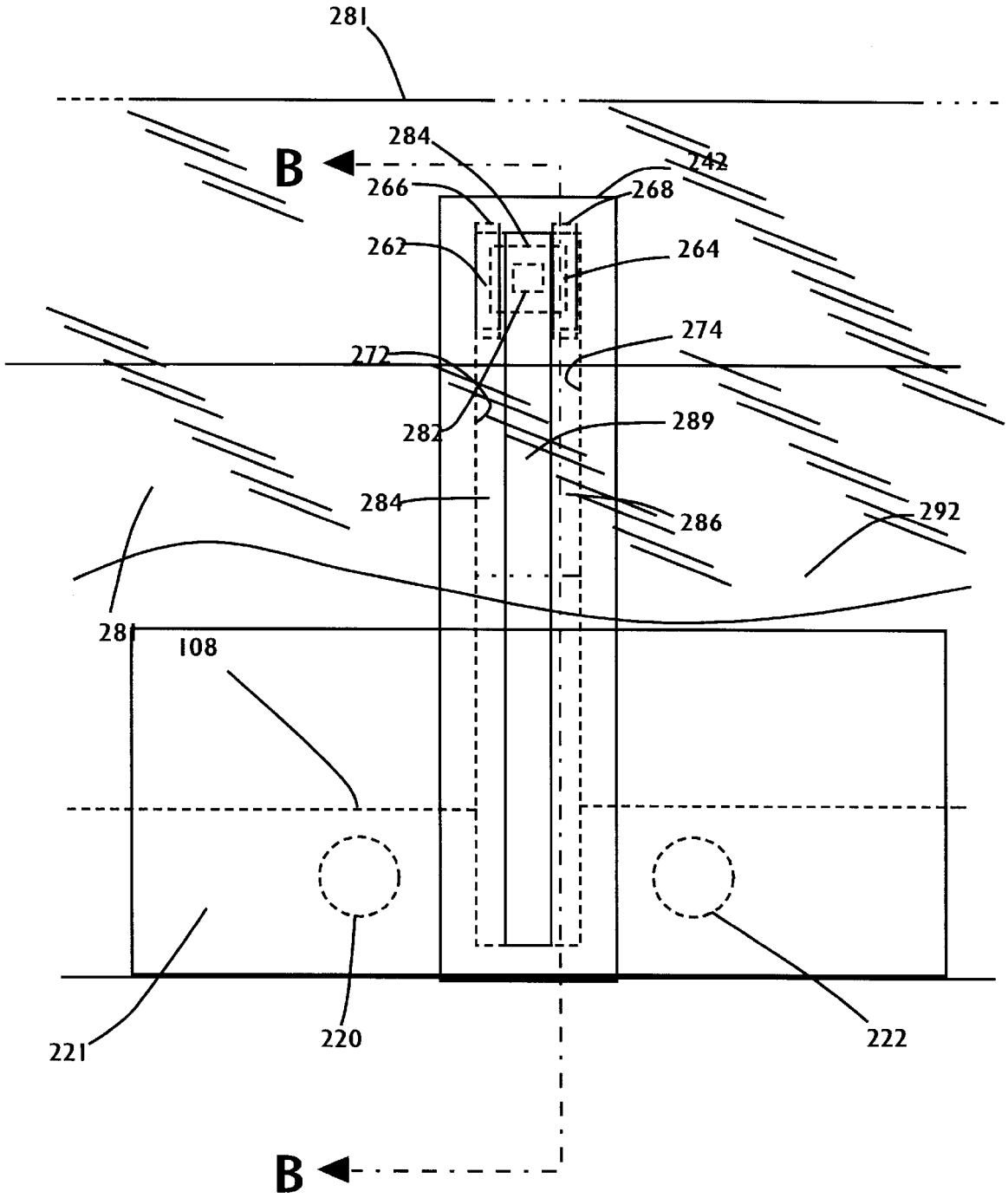
FIG. 7 is a plan view showing a some of the features of FIG. 4 in more detail.

FIG. 5 shows a portion of assembly 200 in more detail, and FIG. 6 is a side view taken along the line A—A of FIG. 5. Eyeshield 234 includes lens 281. (Only a portion of lens 281, proximate to channel 242, is shown in FIGS. 5, 6, and 7, lens 281 having portions extending below and to the sides of the paper of and below the paper of FIGS. 6 and 7.) Eyeshield 234 also includes post 282, and base 284. Channel 242 includes left wall 272, right wall 274, left ceiling 284, and right ceiling 286. Left ceiling 284 and right ceiling 286 define a longitudinal aperture 289. Post 282 extends into aperture 289. Base 284 is locked into channel 242 by ceiling 284 and ceiling 286. Depression 288 helps secure base 284 into the retracted position for shield 234. Metallic band-springs 266 and 268 act to bias base 284 into depression 288.

Envelope 232 and channels 240 and 242 are attached to assembly headband 292 with adhesive (not shown).

Figure 8:
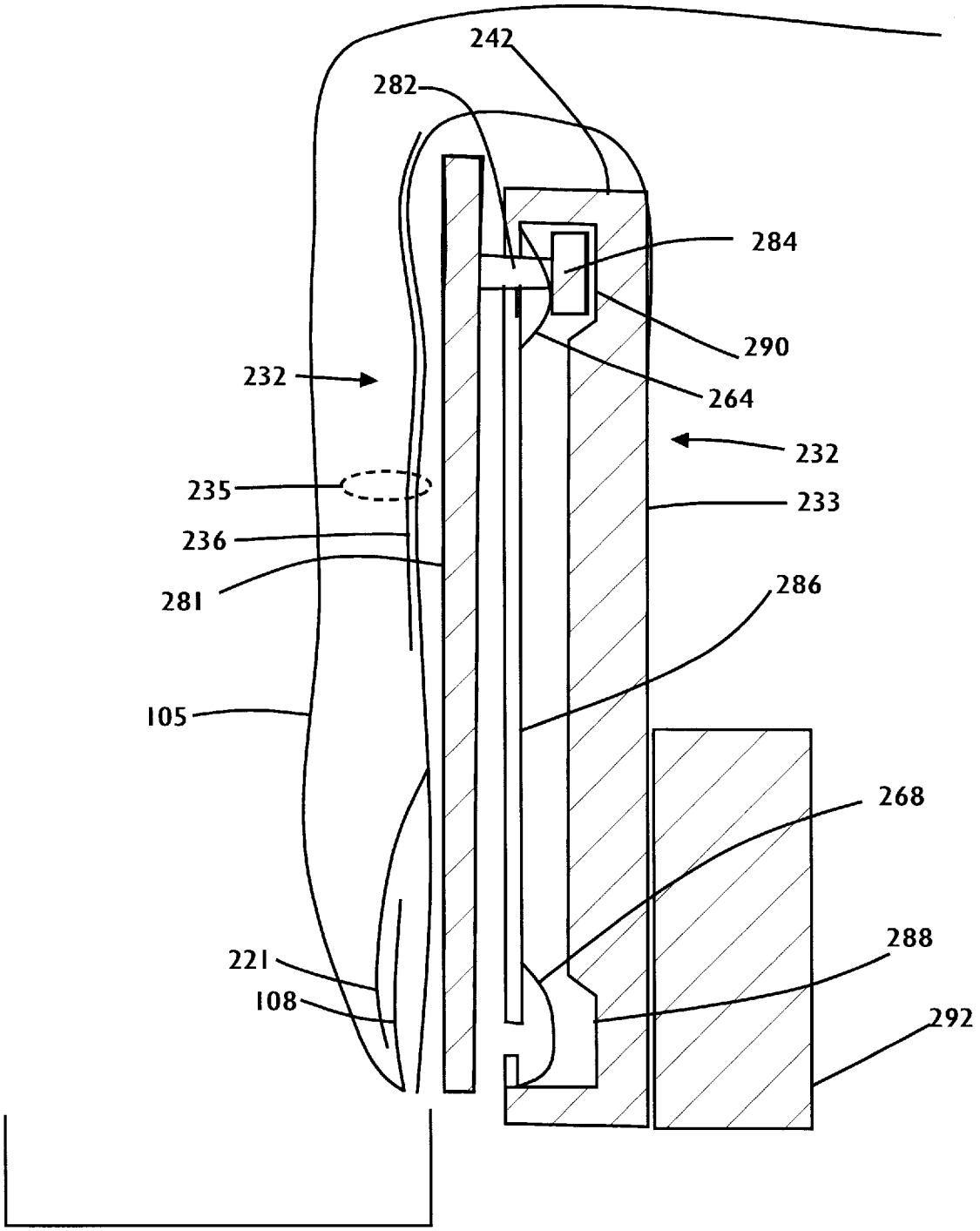
FIG. 8. is a view taken along the line B—B of FIG. 7.

Each of FIGS. 7 and 8 correspond to FIGS. 5 and 6 respectively. FIGS. 7 and 8 show shield 234 in the retracted position, wherein metallic band-springs 262 and 264 bias base 284 into depression 290.

In summary, safety hat 100 included assembly 200, dome 105, and bill 6 attached to dome 105. Dome 105 includes a cloth part with at least one layer of woven cotton fabric, the cloth part defining most of an interior surface of dome 105 and defining most of an exterior surface of the dome 105. In other words, most of dome 105 is non-rigid, having no rigid support structure. Thus, hat 100 differs from rigid head coverings such as motorcycle helmets.

Envelope 232 includes a back wall 233 positioned to define a chamber between the back wall 233 and the interior surface of dome 105. Eyeshield 234 is attached to back wall 233, via channels 240 and 242 allowing movement of eyeshield 234 from a first position inside the chamber, and a second position outside the chamber.

Rim 112 of dome 105 defines a horizontal axis. Each of channels 240 and 242 is essentially a groove defining a longitudinal dimension running transverse to the horizontal axis.

Eyeshield 234 defines a plurality of posts 282 (projections) and a plurality of bases 284 (flanges). Each base 284 is slidably engaged with a respective channel. Thus, channels 240 and 242 act to guide eyeshield 234 during transitions from the retracted position and the extended position of eyeshield 234. The channels also act to limit the motion of eyeshield 234 so that eyeshield 234 remains attached to hat 100.

Posts 282 and bases 284 are injection molded in the same mold with lens 281, meaning that lens 281 and post 282 and bases 284 constitute a single unified element (integrally formed together).

Front wall 235, of envelope 232, opposes back wall 233 through the chamber. Front wall 235 includes adhesive 236 for binding to the interior surface of dome 105. Preferably, adhesive 236 is sold with a removable plastic covering, or laminated paper, which the consumer removes to expose the adhesive just before attaching assembly 200 to a conventional baseball cap.

Adhesive 235 and fasteners 210, 212, 214, 216, 218, 219, 220, 222, 224, 226, 228, and 229 are essentially a mechanism for attaching wall 233 to dome 105, to define a chamber between wall 233 and the interior surface of dome 105.

Channel 240 has the same structure as channel 242.

Figure 9:
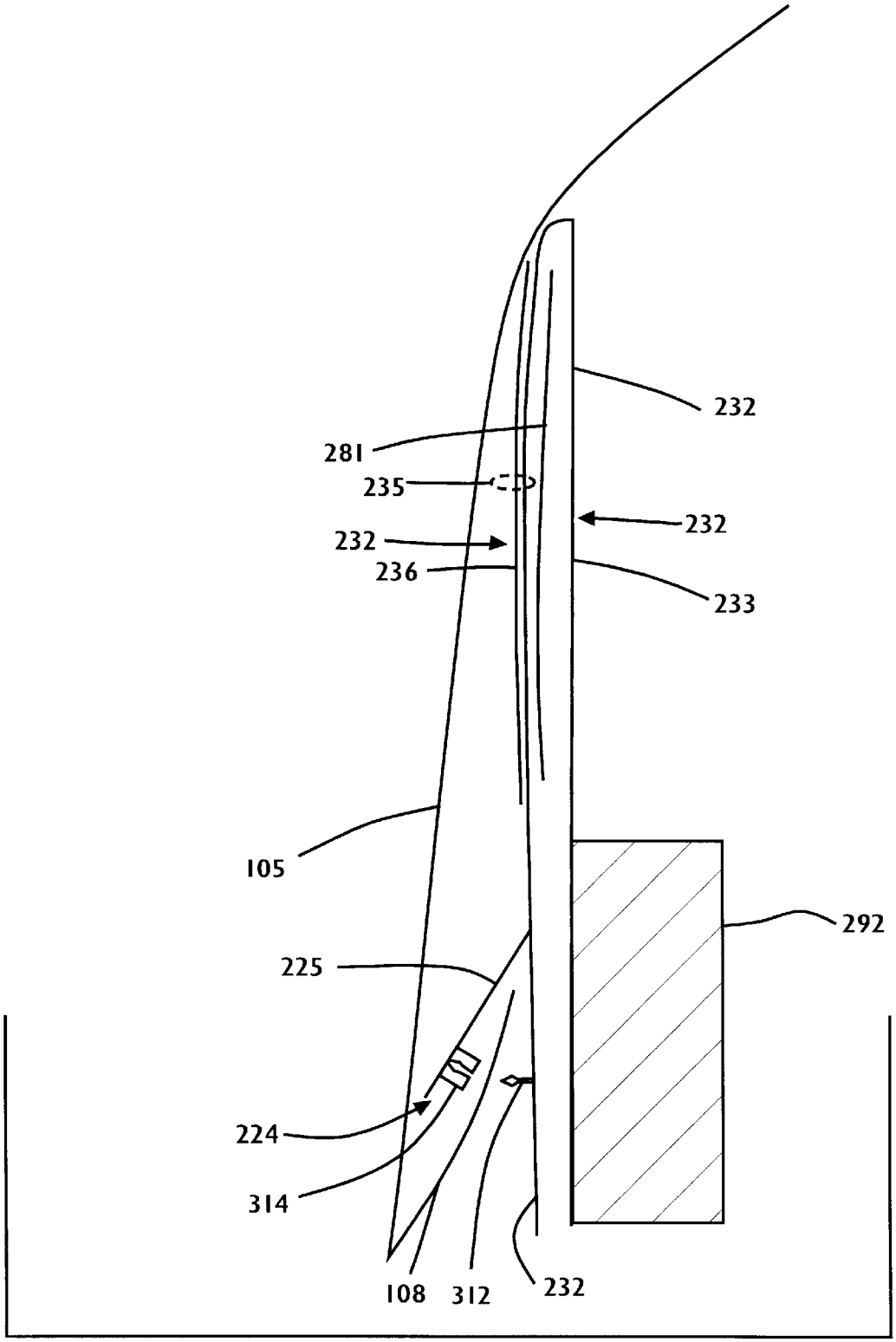
FIG. 9 is a view of a portion of the shield assembly taken along the line C—C of FIG. 1.

FIG. 9 is an exploded view taken along the line C—C in FIG. 1. Hat 100 includes hat headband 108 that extends around the rim 112. Assembly 200 is attached to headband 108 via fastener 224. Fastener 224 has a male portion 312 attached to the main body of envelope 232 and a female portion 314 attached to fabric flap 225, which is attached to the main body of envelope 232. Portion 312 is on one side of hat headband 108 and portion 314 is on the other side of hat headband 108. In other words, portion 314 defines an opening and portion 312 defines a projection for engaging the opening through headband 108. Thus, assembly 200 includes a plurality of fasteners, each fasteners having a convex part and a concave part for opposing the convex part through hat headband 108.

Thus, flaps 221, 225, and 227; fasteners 220, 222, 224, 226, 228, and 229; and the main body of envelope 232 together constitute a mechanism for attaching assembly 200 to the interior surface of dome 105. This connection mechanism is divided into various segments of approximately one inch in length. Flap 221, and fasteners 220 and 222 constitute a first segment. Flap 225, and fasteners 224 and 226 constitute a second segment. Flap 227, and fasteners 228 and 229 constitute a third segment.

Figure 10:
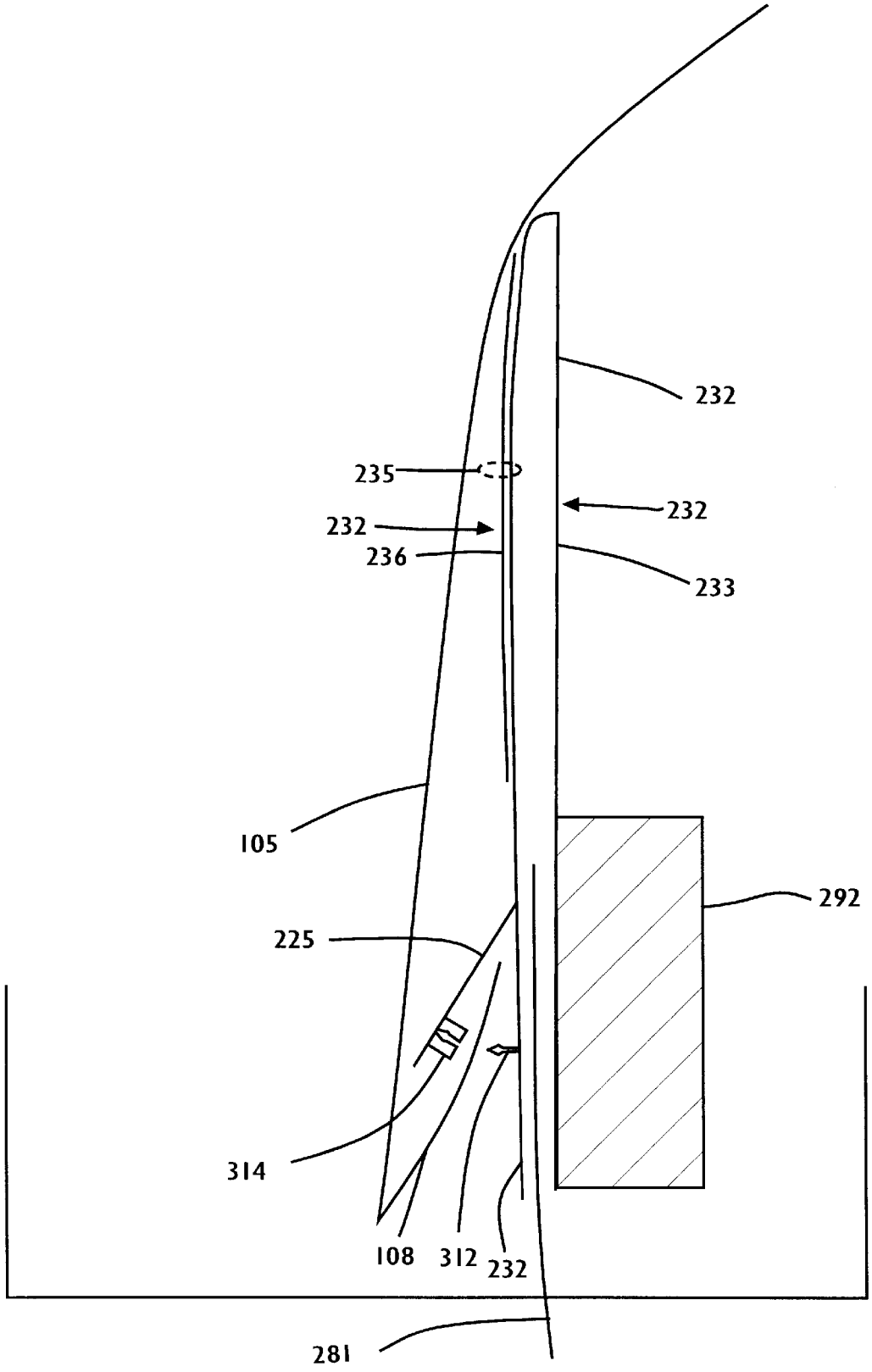
FIG. 10 is a view of a portion of the shield assembly taken along the line D—D of FIG. 2.

FIG. 10 corresponds to FIG. 9 and shows eyeshield 234 in the extended position.

Headband 292 defines a thickness of at least 0.25 inch. Headband 292 acts to space envelope 232 and, therefore, eyeshield 234 away from the wearer's head. Thus, headband 292 helps to ensure that eyeshield 234 will clear the wearer's head when eyeshield 234 is in the extended position.

According to another aspect of the first preferred embodiment of the present invention, assembly 200 is for attaching to a conventional baseball cap having a dome, and a bill attached to the dome, the dome including a cloth part with at least one layer of woven fabric, the cloth part defining most of an interior surface of the dome and defining most of an exterior surface of the dome.

Figure 11:
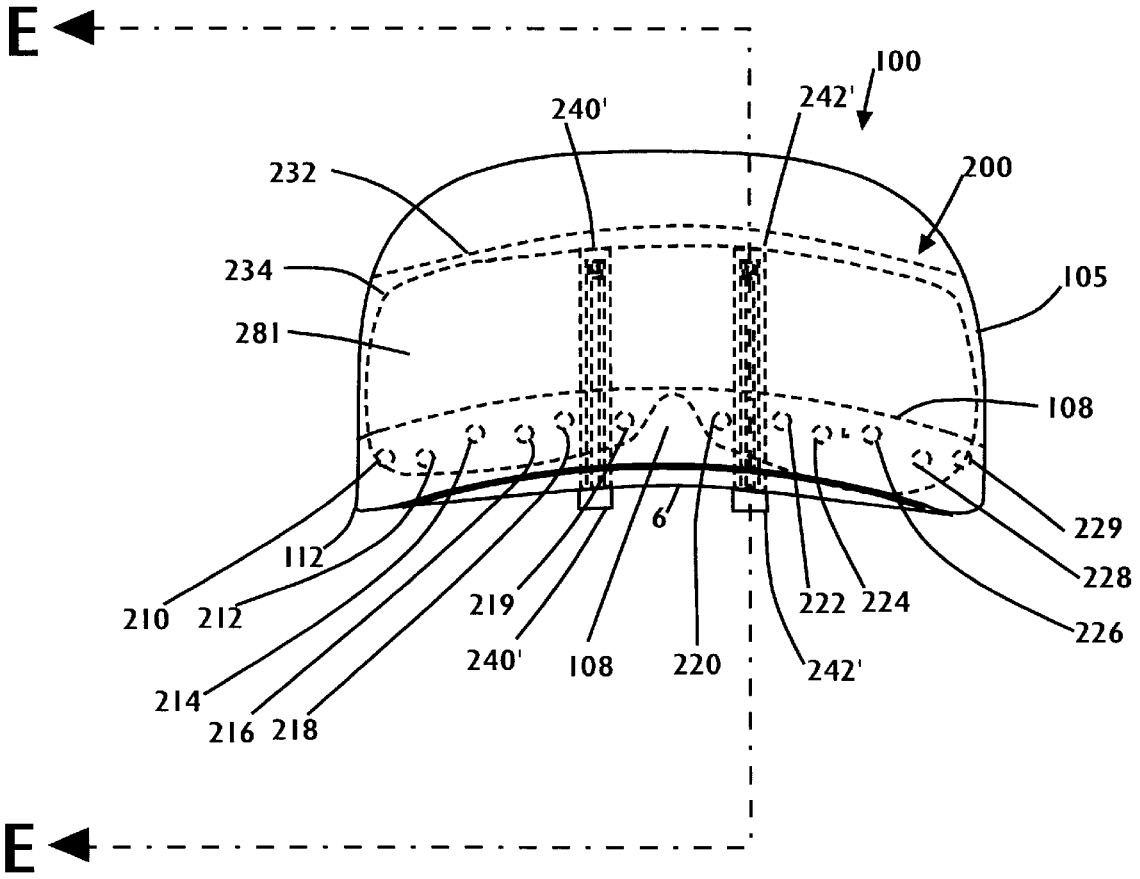
FIG. 11 is a view of a portion of an eyeshield assembly according to the second preferred embodiment of the present invention.
Figure 12:
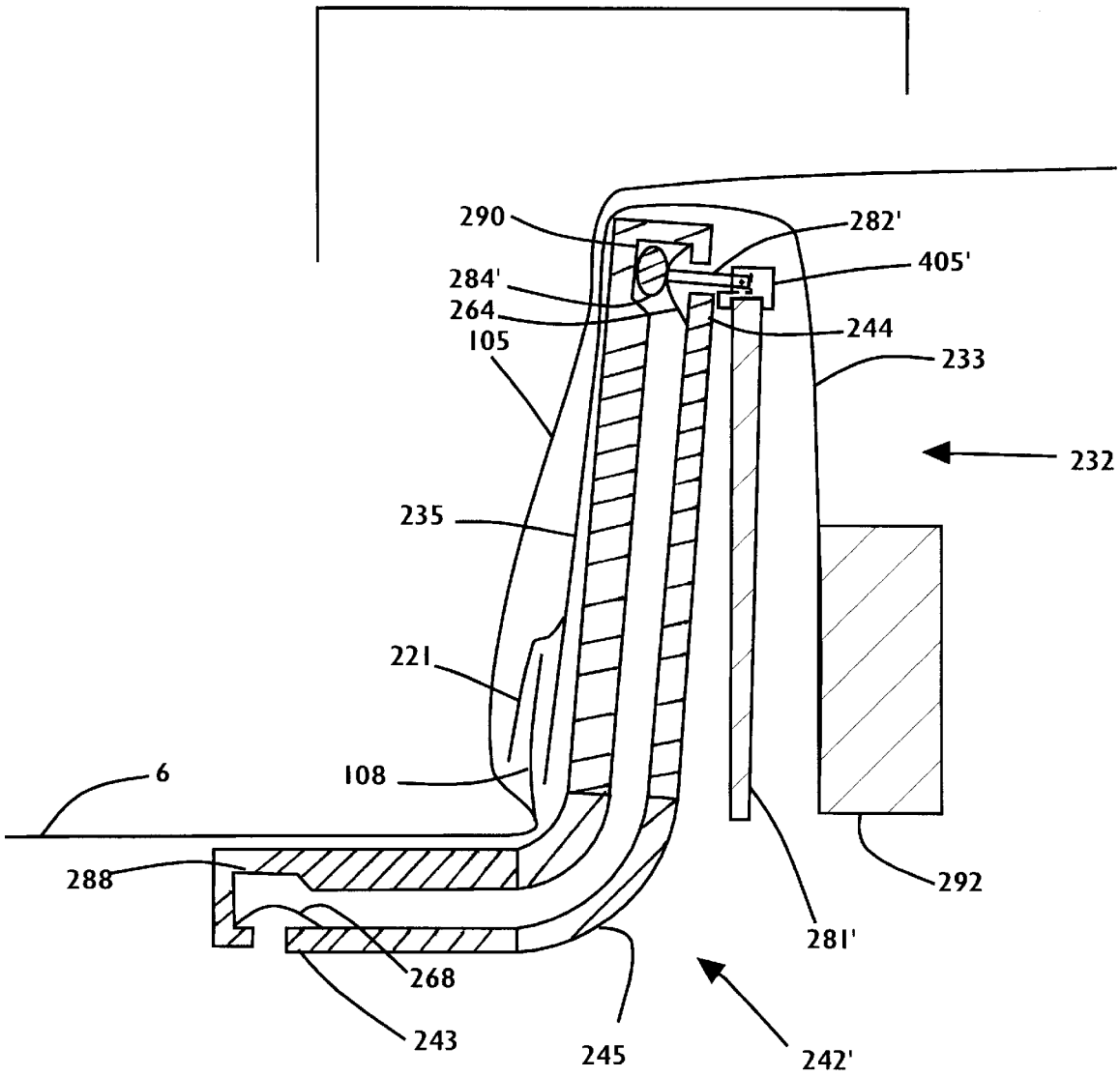
FIG. 12 is a view taken along the line E—E of FIG. 11.

FIG. 11 shows an eyeshield assembly according to second preferred embodiment of the present invention, and FIG. 12 is a partially exploded view take along the line E—E in FIG. 11. The second preferred embodiment includes each element present in the first preferred embodiment described and illustrated above, except that angled channels 240' and 242' are present instead of channels 240 and 242; and lens 281', post 282', and base 284' are not integrally formed together. Unlike the channels of the first preferred embodiment, channels 240' and 242' of the second preferred embodiment are attached to the front wall 235 of sleeve 232. Angled channels 240' and 242' extend out under bill 6. This extension under bill 6 allow lens 281' to slide forward away from the face of the wearer in the extended position.

Channel 242' includes a substantially horizontal end 243, a substantially vertical 244, and a curved middle part 245.

Channel 240' has the same structure as that of channel 242'.

Figure 13:
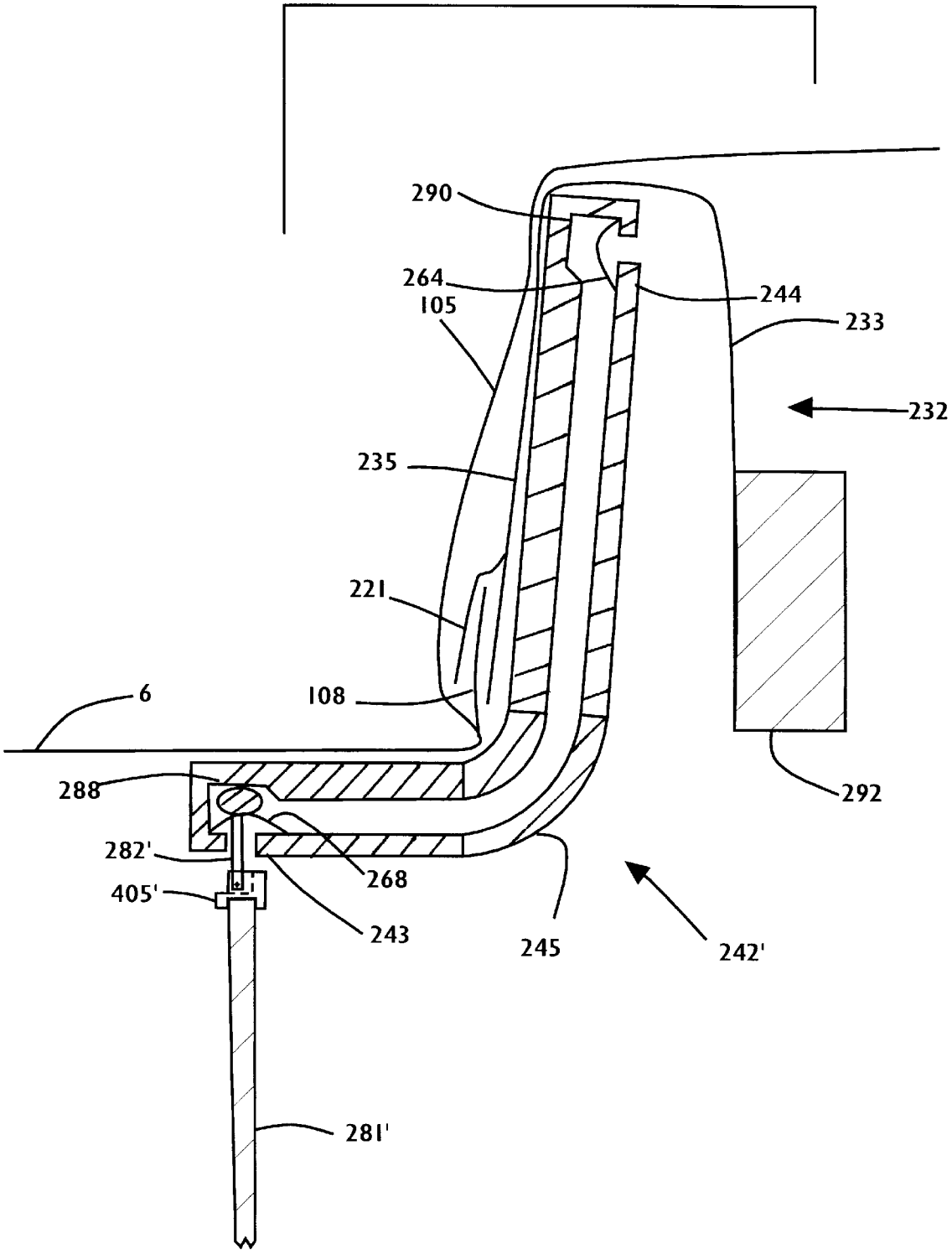
FIG. 13 is a view showing the second preferred eyeshield assembly with the lens in the extended position.

FIG. 13 shows lens 281 ' in the extended position. As shown in FIGS. 12 and 13, post 282' rotates relative to lens 281' when lens 281' make the transition between the retracted and extended positions.

Figure 14:
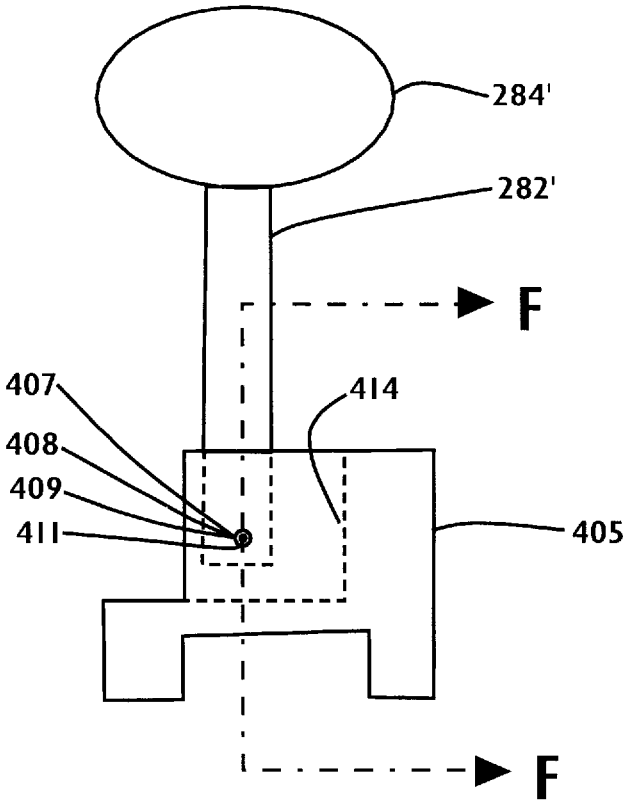
FIG. 14 is a diagram showing some elements of FIG. 13 is more detail.
Figure 15:
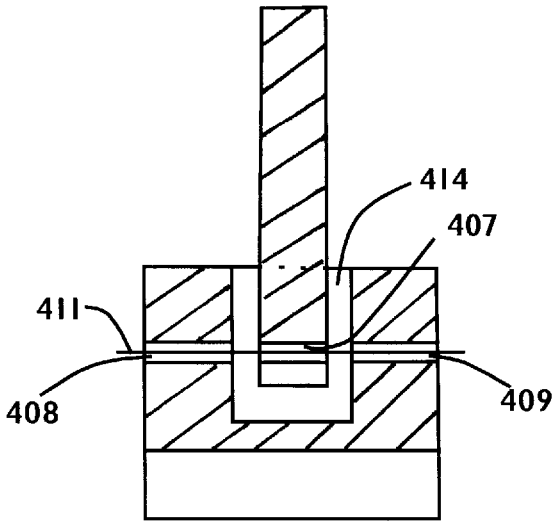
FIG. 15 is a view taken along the line F—F in FIG. 14.

FIG. 14 shows lens connection member 405, post 282', and base 284' in more detail, and FIG. 15 is a view taken along the line F—F in FIG. 14. Base 284' has a rounded shape allowing base 284' to slide through curved part 245 of channel 242'. Post 282' defines a hole 407 and lens connection member 405 defines holes 408 and 409 aligned with hole 407. Metal pin 411 extends through holes 407, 408 and 409, thereby acting as an axle. Thus, pin 411 and holes 407, 408 and 409 act as a hinge allowing lens 281' to have a substantially vertical orientation in both the extended position, where channel 242' has a substantially horizontal orientation, and in the retracted position where channel 242' has a substantially vertical orientation.

Wall 414, of connection member 405', prevents lens 281 ' from over rotating in the extended position, and contacting the face of the wearer.

Thus, channel 242' defines a sliding path for lens 281', the sliding path having a substantially horizontal first end 243 and a substantially vertical second end 244. First end 243 extends under bill 6. Horizontal first end 243, curved part 245, and vertical second end 244 may be integrally form together using injection molding.

The drawings do not necessarily reflect a scaled view of the preferred hat assemblies.

It is preferred that the horizontal end of channel 242' extend out under bill 6 by a sufficient amount such that lens 281' clears the face of the wearer in the extended position. It is presently preferred that the horizontal end of channel 242' extend out under bill 6 by a sufficient amount such that lens 281' clears the face of the wearer by at least 0.5 inch.

Figure 16:
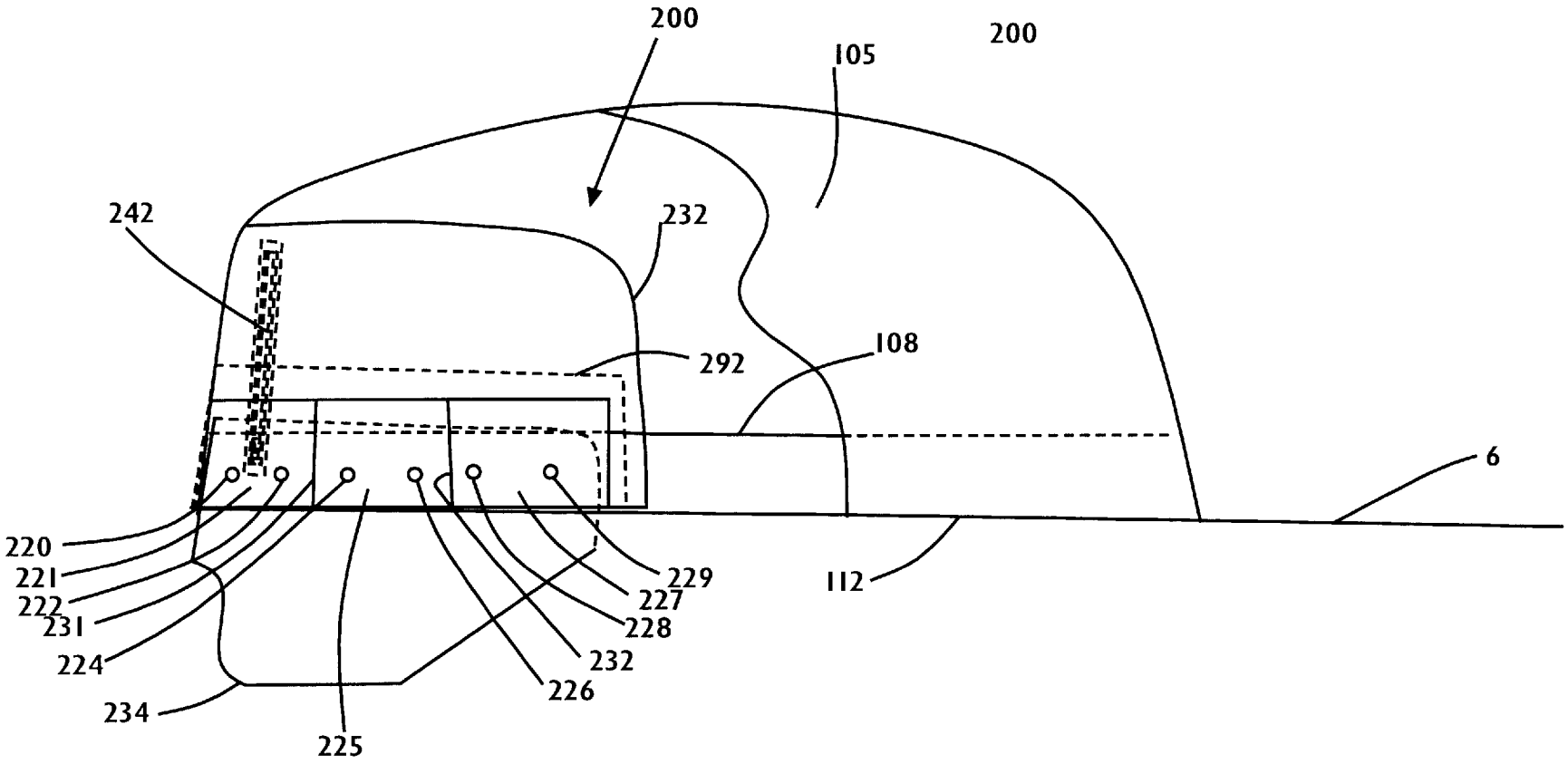
FIG. 16 is a side view showing a third preferred embodiment of the present invention, with the eyeshield in the extended position.

FIG. 16 shows a hat according to a third embodiment of the present invention. In the third preferred hat, eyeshield 234 is on one side of the hat and bill 6 is on a different side of the hat. In other words, eyeshield 234 is in vertical disalignment with the bill 6.

If the preferred safety hats are constructed by a consumer that purchases assembly 200 separately from the cap, eyeshield 234 should be in the retracted position when the consumer removes the plastic covering from adhesive 235 and bonds the outer wall of envelope 232 to the interior surface of dome 105. Performing this bonding step with eyeshield 234 in the retracted position helps to ensure that channels 240 and 242 will be mutually parallel, allowing the respective bases 282 to slide within each of channels 240 and 242.

Although the illustrated assemblies includes adhesive 236 for attaching envelope 232 to the interior surface of dome 105, such an attachment may also be implemented with sewing. Attachment by sewing may be advantageous when the safety hat is assembled in a factory rather than by a consumer that purchases assembly 200 for attaching to a conventional baseball cap. It is contemplated that the front wall, and mechanism for attaching the front wall to the interior surface of the cap, may be omitted, provided that the assembly is otherwise attached to the cap.

Although the illustrated embodiment has projections engaged with channels in the assembly envelope, an alternative embodiment could have the channels on the shield and fixed projections in the envelope engaging the shield channels.

Thus, the preferred embodiments of the present invention provide an eye protection mechanism that is both convenient and comfortable. These advantages of the preferred embodiment encourage the use of eye protection and, ultimately, facilitate the prevention of serious eye injury.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims.

What is claimed is:

1. A hat for wearing on the head of a person and for protecting the eyes of the person, the hat comprising:

a dome including a cloth part with at least one layer of woven fabric, the cloth part defining most of an interior surface of the dome and defining most of an exterior surface of the dome, a first member positioned to define a chamber between the member and the interior surface, an eyeshield, and means for guiding the eyeshield from a first position inside the chamber to a second position outside the chamber, by guiding the eyeshield in a first direction, and in a subsequent direction different from the first direction, wherein the subsequent direction in not the reverse of the first direction.

2. The hat of claim 1 further including a second member, contacting the interior surface, and opposing the first member through the chamber.

3. The hat of claim 2 wherein the second member includes adhesive.

4. The hat of claim 1 further including a headband, wherein the member is attached to the headband.

5. The hat of claim 4 wherein the member includes a plurality of fasteners, each fastener having a first part, and a second part for opposing the first part through the headband.

6. The hat of claim 5 wherein each first part defines an opening and each second part defines a projection for engaging the opening through the headband.

7. The hat of claim 1 further including a guiding member defining a sliding path for the eyeshield, the sliding path extending substantially parallel to a horizontal plane at a second end.

8. The hat of claim 1 further including a bill attached to the dome, the bill extending at least 2 inches away from the eyeshield, wherein the guiding means extends under the bill.

9. The hat of claim 1 further including a bill attached to the dome, the bill extending away from the dome, wherein the eyeshield is in vertical disalignment with the bill.

10. The hat of claim 1 further comprising a spacing member, attached to the member, for spacing the eyeshield away from the head, wherein the spacing member defines a thickness of at least 0.25 inch.

11. The hat of claim 1 further including a bill attached to the dome, the bill extending at least 2 inches away from the eyeshield.

12. The hat of claim 1 wherein the dome defines a horizontal axis, and the hat further includes a groove defining a longitudinal dimension running transverse to the horizontal axis; and a projection having a first end defining a flange, and a second end, the first end being slidably engaged with the groove and the second end being attached to the eyeshield.

13. The hat of claim 12 wherein the projection is integrally formed with the eyeshield.

14. An assembly for protecting the eyes of a person and for attaching to a hat for wearing on the head of the person, the hat including a dome with a cloth part with at least one layer of woven fabric, the cloth part defining most of an interior surface of the dome and defining most of an exterior surface of the dome, the assembly comprising:

a first wall;

a mechanism for attaching the wall to the hat, to define a chamber between the wall and the interior surface; and an eyeshield; and means for guiding the eyeshield from a first position inside the chamber to a second position outside the chamber, by guiding the eyeshield in a first direction, and in a subsequent direction different from the first direction, wherein the subsequent direction in not the reverse of the first direction.

15. The assembly of claim 14 further including a second wall for contacting the interior surface, and opposing the first wall through the chamber.

16. The assembly of claim 15 wherein the second wall includes adhesive.

17. The assembly of claim 14 wherein the hat further includes a headband, and the assembly is attachable to the headband.

18. The assembly of claim 14 wherein the mechanism includes a plurality of fasteners, each fastener having a first part, and a second part for opposing the first part.

19. The assembly of claim 18 wherein the hat further includes a headband, and wherein each first part defines an opening and each second part defines a projection for engaging the opening through the headband.

20. The assembly of claim 15 wherein the mechanism for attaching includes a plurality of segments.

21. The assembly of claim 14 wherein the eyeshield includes a projection slidably engaged with the guiding means.

22. The assembly of claim 14 further comprising a spacing member, attached to the wall, for spacing the chamber away from the head, wherein the spacing member defines a thickness of at least 0.25 inch.

23. The assembly of claim 14 wherein the dome defines a horizontal axis, and the assembly further includes a groove defining a longitudinal dimension running transverse to the horizontal axis; and a projection having a first end defining a flange, and a second end, the first end being slidably engaged with the groove and the second end being attached to the eyeshield.

24. The assembly of claim 23 wherein the projection is integrally formed with the eyeshield.

25. In a system including an eyeshield, and a hat for wearing on the head of the person, the hat including a dome defining a dome volume, the dome including a cloth part with at least one layer of woven fabric, a method comprising the steps of:

attaching the eyeshield to the hat at a first position inside the dome volume;

guiding the eyeshield in a first direction;

subsequently, guiding the eyeshield in a second direction different from the first direction, wherein the second direction in not the reverse of the first direction; and attaching the eyeshield to the hat at a second position outside the dome volume.

* * * * *

UNITED STATES PATENT AND TRADEMARK OFFICE

CERTIFICATE OF CORRECTION

PATENT NO. : 5,815,832
DATED : October 6, 1998
INVENTOR(S) : Skolik

It is certified that error appears in the above-identified patent and that said Letters Patent is hereby corrected as shown below:

In column 2, line 32, change "Such" to –such–

In claim 1, line 15, change "in" to –is– .

In claim 14, line 9, after "surface;" delete "and" ; and line 15, change "in" to –is– .

In claim 25, line 11, change "in" to –is–.

Signed and Sealed this

Twenty-third Day of March, 1999

*Attest:*

Q. TODD DICKINSON

*Attesting Officer*

*Acting Commissioner of Patents and Trademarks*